US005330401A

United States Patent [19]

Walstead

[11] Patent Number: 5,330,401

[45] Date of Patent: Jul. 19, 1994

[54] SUSPENSION SYSTEM FOR TREADMILL WITH RESILIENT SURFACE

[75] Inventor: James W. Walstead, Baytown, Tex.

[73] Assignee: Orbiter Royalty Trust, Baytown, Tex.

[21] Appl. No.: 25,222

[22] Filed: Mar. 2, 1993

[51] Int. Cl.[5] ..... A63B 22/02

[52] U.S. Cl. ..... 482/54; 198/838; 198/845

[58] Field of Search ..... 482/54, 27; 198/838, 198/845

[56] References Cited

U.S. PATENT DOCUMENTS

| | | |
|---|---|---|
| 1,016,729 | 2/1912 | Barrett . |
| 2,017,885 | 10/1935 | Atcheson . |
| 2,370,990 | 3/1945 | Nissen . |
| 3,095,947 | 7/1963 | Beaulaurier . |
| 3,608,898 | 9/1971 | Berlin . |
| 3,901,379 | 8/1975 | Bruhm . |
| 3,917,092 | 11/1975 | McGinnis . |
| 4,024,949 | 5/1977 | Kleysteuber et al. . |
| 4,509,510 | 4/1985 | Hook . |
| 4,614,337 | 9/1986 | Schönenberger . |
| 4,747,747 | 5/1988 | Fusco et al. . |
| 4,938,473 | 7/1990 | Lee et al. . |
| 4,955,466 | 9/1990 | Almes et al. . |
| 5,203,800 | 4/1993 | Meredith . |

*Primary Examiner*—Robert Bahr
*Assistant Examiner*—Lynne A. Reichard
*Attorney, Agent, or Firm*—Pravel, Hewitt, Kimball & Krieger

[57] ABSTRACT

A treadmill with a trampoline-like surface having an endless belt adapted to travel between two guide rails. The treadmill includes an improved suspension system formed from a flexible wire cable that connects two adjacent reinforced openings formed near the lateral edges of the belt to a carrier that moves on the guide rails of the treadmill.

9 Claims, 2 Drawing Sheets

SUSPENSION SYSTEM FOR TREADMILL WITH RESILIENT SURFACE

BACKGROUND OF THE INVENTION

This invention relates to treadmills with trampoline-like surfaces and, more particularly, to an improved suspension system for suspending the mat or belt between a supporting surface in such an apparatus.

Treadmills utilize an endless moving belt that allows an individual to walk, jog or run in place. Treadmills are useful not only for exercise, but for rehabilitation programs and medical testing such as the "stress test" which is commonly used. There is a demand for treadmills in indoor health clubs since many clubs are not able to build a running track and a treadmill provides the capability of a well-rounded exercise program.

Most treadmills are formed with a thin, endless belt which travels over a supporting surface so that the belt can withstand the weight of the individual using it. The rigid surface beneath the belt in these treadmills can cause shin splints or other stress-related injuries to the legs of the user. The use of treadmills of this design in rehabilitation programs is limited because of the impact on the legs of the users.

It has been found that a treadmill which utilizes a trampoline-like surface with a built-in resiliency reduces impact on the legs of the users to the point where such a machine can be used as a primary therapeutic aid for rehabilitation from leg injuries. because it significantly reduces the wear and tear on the legs of the user.

U.S. Pat. No. 4,938,473 which issued on Jul. 3, 1990 describes a treadmill with a trampoline-like surface. The suspension system of this treadmill is made from a pair of springs spaced at an angle between each carrier and the belt to provide lateral support and stability for the belt. However, belts which utilize springs have a tendency to be unstable and the spring fatigue causes the belt to become slack. Further, springs have been found to increase the expense of maintenance to the machine due to spring failure and spring cuts.

An improvement over a spring suspension system is described in U.S. application Ser. No. 657,439 which was filed on Feb. 19, 1991, which is incorporated as though fully set forth. In this application an improved treadmill with a trampoline-like surface having rail carriers attached directly to the lateral edges of the belt is disclosed. The suspension system includes rail carriers extending over the lateral edges of the belt with a bolt that extends downward from the rail carrier, being inserted through grommets in the belt and secured on the belt underside by a nut. The rail carriers provide tension to the belt.

In order to maintain the correct amount of tension with this suspension system, the dimensions of the width of the belt and the placement of the grommets along the belt edge are extremely important. Very little variation in these dimensions is adjustable in the manufacture of the treadmill. Additionally, the belt has a tendency to stretch over time creating decreased belt tension. This causes excessive noise and instability of the carriers as they roll around the rails of the treadmill.

Due to the problems mentioned above, an improved suspension system that eliminated the use of springs or a rigid belt-carrier connection would improve the structure and performance of the apparatus.

SUMMARY OF THE INVENTION

An improved suspension system for a treadmill with a trampoline-like surface has been developed which solves the problems mentioned above by replacing a spring or rigid carrier suspension system with a wire cable suspension system. The wire cable suspension system is formed of a flexible wire cable that connects two adjacent reinforced openings formed near the lateral edges of the belt to a carrier than moves on the rails of the treadmill.

The wire cable support system is used with a treadmill frame where the upper surface of a belt is adapted to form an exercising surface. The frame includes supports at each end of the belt so that the belt can provide a movable surface. The supports also include guide rails spaced apart from the lateral edges of the belt so that a series of carriers can be used to connect the belt to the rails and travel with the belt along the guide rails as the belt moves along its path.

In a preferred embodiment, the treadmill belt is formed with a substantially non-resilient center and edge sections, with a resilient section between the non-resilient sections. Grommets are spaced along the non-resilient lateral edges of the belt and the wire cable suspension system connects the belt to the rail carriers by attachment through the grommets on the belt. The suspension system provides the tension to the belt suspended between the treadmill frame.

In this way, springs or rigid connectors which were located in prior art machines between the lateral edges of the belt and the guide rails have been eliminated to provide a simpler and more effective machine for achieving the advantageous results described above.

BRIEF DESCRIPTION OF THE DRAWINGS

For a better understanding of the invention, reference should be made to the detailed description of exemplary embodiments set forth below, considered in conjunction with the appended drawings, in which.

Figure 1:
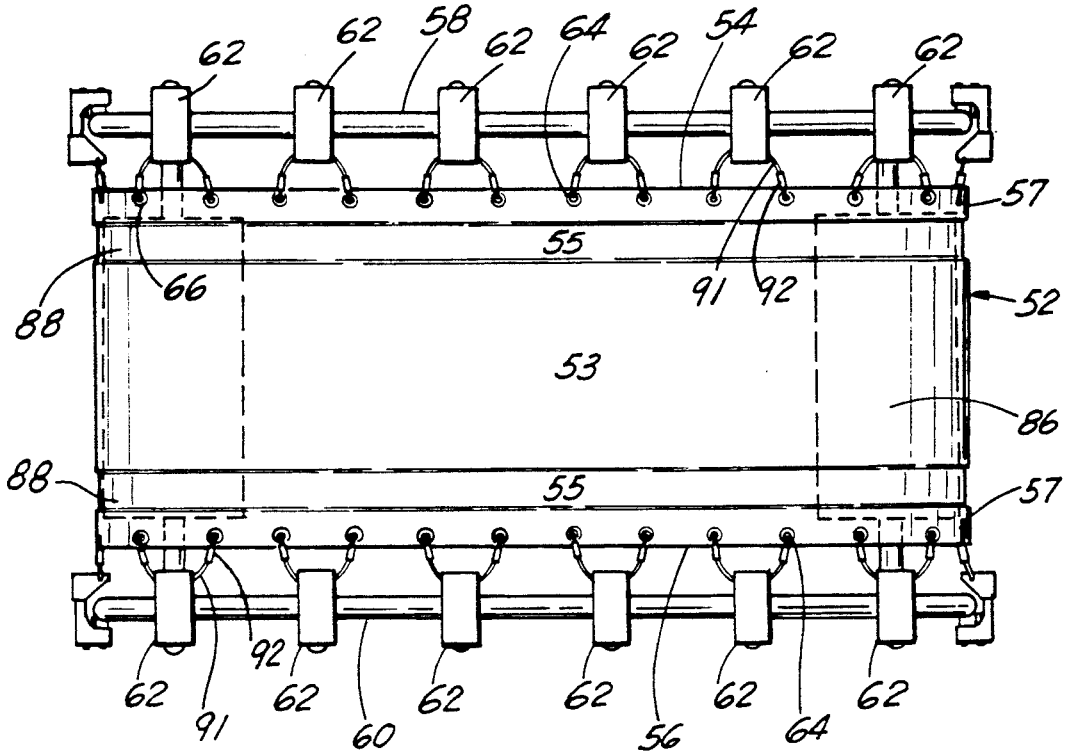
FIG. 1 is a top plan view of a treadmill with a trampoline-like surface having a wire cable suspension system manufactured in accordance with the present invention.
Figure 2:
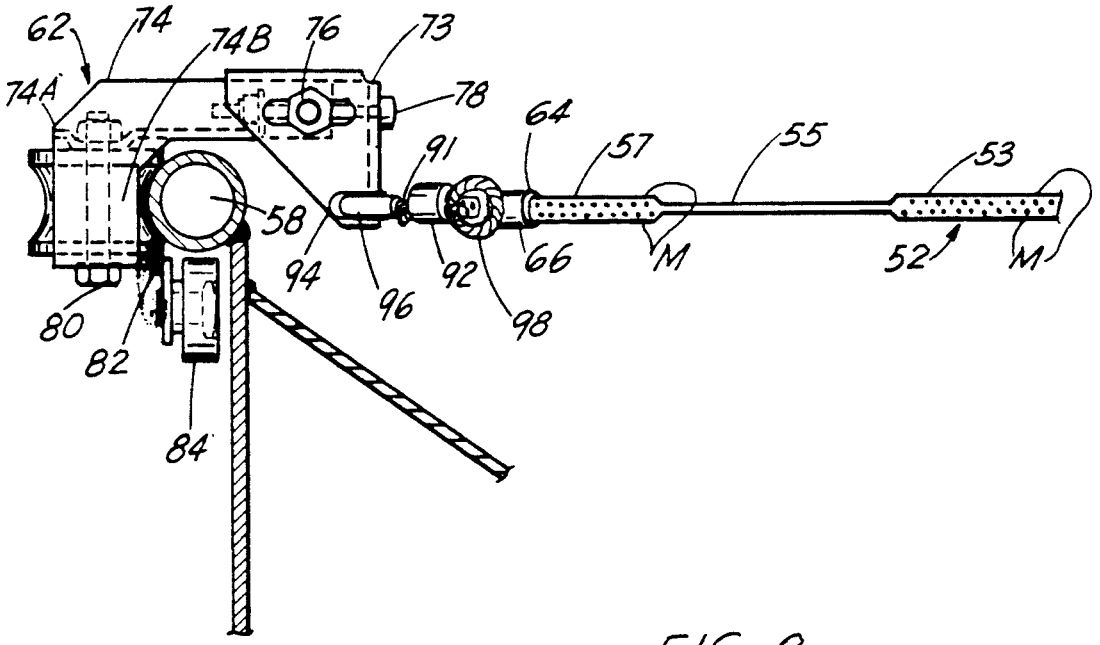
FIG. 2 is a partial sectional view of wire cable suspension system made in accordance with the present invention, along with a carrier used to connect the belt to a guide rail.
Figure 3:
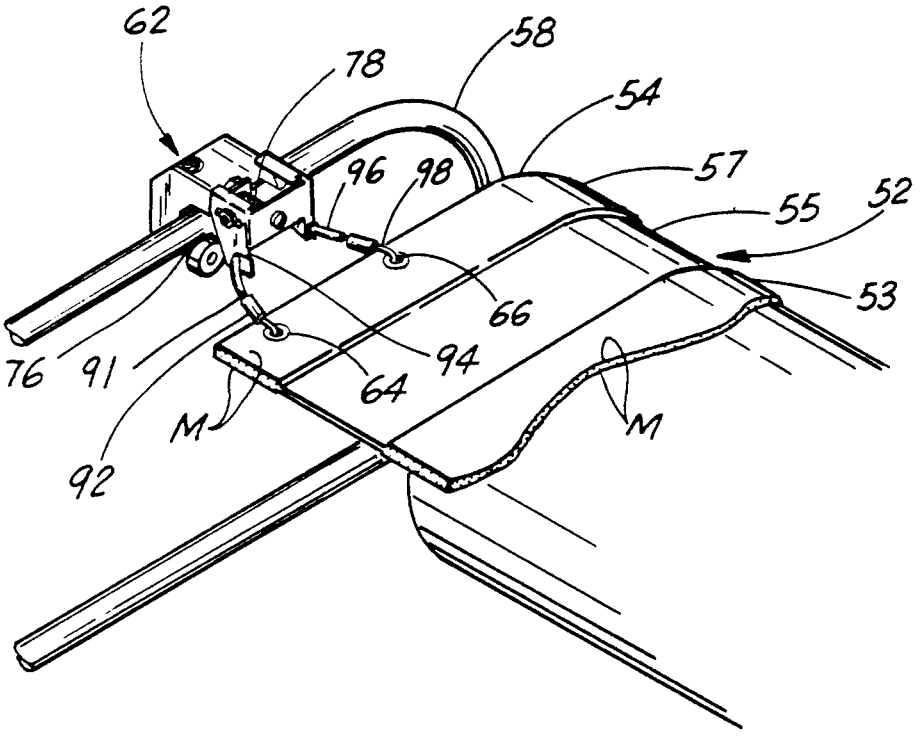
FIG. 3 is a perspective view of one of the carriers and the wire cable suspension system for connecting the belt to a rail as shown in FIG. 3.

DETAILED DESCRIPTION OF EXEMPLARY EMBODIMENTS:

FIGS. 1–3 illustrate a preferred embodiment of the improved suspension system formed in accordance with the invention. FIG. 1 shows a treadmill with a trampoline-like surface suspended between a frame. A belt 52 with lateral edges 54,56 is connected to support rails 58,60 by means of carriers 62. The belt 52 is formed with a center, non-resilient section 53 bounded on both edges by resilient sections 55 which impart resiliency to the belt 52. An outer reinforced section 57 is located outside each resilient section 55 so that the lateral edges 54,56 of the belt 52 can be connected to carriers 62 as described below. Grommets 64 are incorporated in openings 66 formed along the reinforced outer sections 57 of the belt 52. As best seen in FIG. 3, the carriers 62 are connected to the reinforced outer sections 57 of the belt 52 by a length of flexible wire cable 91 that is threaded through both the carrier 62 and grommets 64 in the opening 66 and secured by a crimp 92. As shown in FIG. 1, a plurality of carriers 62 are connected to the belt 52.

Each carrier 62 is formed of two sections 73,74 which are connected to each other through a pair of carrier bolts 76 (FIG. 2) which can be loosened in order to fix the distance between the guide rail 58 and the lateral edge 54 of the belt 52. A machine screw 78 is located between the sections 73,74 of the carrier 62 for adjusting the tension of the belt when used in conjunction with the carriage bolts 76. The carrier 62 may also be formed in one section without the adjustable feature provided by the carrier bolts 76 or the machine screw 78.

As best shown in FIGS. 2 and 3, the carrier section 73 is in the form of a wire cable thimble with parallel openings 94 through which the cable 91 is threaded. In the installation of the wire cable suspension system one end of the flexible wire cable 91 is threaded through a grommet 64 in the opening 66 on the outer edge 57 of the belt 52. A tight loop 98 in the cable 91 is formed by a swage 92 that is crimped around the looped cable sections. The tight loop 98 compresses the edge 54 of the belt 52 restricting movement of the cable 91 in the grommet 64. The cable 91 is then passed through a sheath 96 of nylon or other suitable protective cladding material and threaded through the opening 94 in the section 73 of the carrier 62. The sheath 96 prevents any metal to metal contact between the wire cable 91 and the section 73 of the carrier 62. The loose end of the cable 91 is then threaded through the next adjacent grommet 64 in the belt 52. The cable 91 is pulled to apply tension to the belt 52 and a tight loop 98 is formed by a crimping swage 92. The excess cable 91 is trimmed and the next carrier 62 is installed on the opposite side of the belt 52 in the same manner.

The tension applied to the cables 91 varies with the anticipated use of the treadmill. If the treadmill use will be heavy, such as that found in athletic training facilities, the tension applied to the cables 91 is greater. However, if the treadmill will be used in a rehabilitation facility, the tension can be of a lesser amount. Regardless of the tension applied to each cable 91, the lateral edges 54,56 of the belt 52 will essentially be the same equal distance from the support rails 58,60 after all the carriers 62 have been attached to the belt 52.

The process of connecting the wire cables 91 to the belt 52 is continued until both lateral belt edges 54,56 are secured to the carriers 62. In a preferred embodiment of the invention, the wire cable is formed from 3/32 inch diameter aircraft cable with a minimum of seven (7) strands and nineteen (19) wires per strand.

The carrier section 74 is formed of two pieces, an outer frame 74A and an inner section 74B which provides for an inner bolt hole for a bolt 80, which connects the carrier section 74 to a roller 82 that engages the outer edge of the rail 58. The rollers 82 travel along the rail 58 as the belt 52 moves. A second roller 84 engages the bottom edge of the rail 58 to provide added stability to each carrier 62.

As the belt 52 moves relative to the rails 58,60 which can be accomplished either by the walking or running action of the subject or by a suitable motorized drive (not shown), the carrier 62 will move along the rails 58 and 60 at a predetermined location to provide the proper tension in the mat 52. The ends of the mat 52 are supported by a roller drum 86 preferably located at the back end of the apparatus and a pair of roller supports 88 formed of pneumatic tires that are located at the front end of the apparatus.

If a drive means is to be used, it is preferably connected to one or both of the pneumatic rollers 88 which provide satisfactory frictional contact with the bottom surface of the belt 52 in order to drive the belt.

The belt is formed as a continuous web of laminated resilient material such as butyl rubber (not specifically shown), with one or more layers of a non-resilient material such as nylon mesh, represented by the sectional depiction of strands designated by letter M, which is incorporated between layers of resilient material in the reinforced sections. The belt is formed by laminating layers of butyl rubber and incorporating layers of nylon mesh between the layers of butyl rubber such that as the belt is formed the ends of the laminations are at different locations along the length of the belt so that when the belt is formed it is essentially seamless. As shown best in FIG. 2 and 3, the resilient sections 55 are shown in exaggerated thinner dimension relative to the non-resilient sections 53,57 which include the layers of nylon mesh. The belt 52 could also be formed entirely of laminated butyl rubber with a resiliency inherent in the entire structure of the mat. In a preferred embodiment shown in FIG. 1, the belt would be formed entirely of laminated butyl rubber with reinforced sections including one or more layers of nylon mesh, as described above. The actual method of forming the belt is considered to be a proprietary process of the Goodyear Tire & Rubber Company, Lincoln, Nebr.

As the belt 52 rotates and is stretched due to a runners stride, the wire cable 91 angle changes a slight amount resulting in negligible motion on the carrier section 73 or the grommets 64. This results in minimal wear to the suspension system. The constant tension on the stretched belt 52 holds the carriers 62 tightly against the rails 58,60 eliminating excessive noise and carrier instability as the carriers 62 roll around the rails 58,60. If the belt 52 stretches with time, the wire cables 91 can be cut and replaced allowing reuse of the stretched belt 52. Additionally, with the use of the wire cable suspension system the dimension of the width and the placing of the grommets 64 on the belt 52 are not critical since the wire cable 91 sections can vary in length to achieve the proper tension on the belt 52 as the treadmills are assembled. This greatly lowers both the production and maintenance cost of the treadmill.

By utilizing an improved suspension system as described above, the advantages discussed are imparted to a treadmill using a trampoline-like surface. It should be understood that other improvements and modifications can be made to the invention without departing from the scope of the invention as set forth in the appended claims.

I claim:

1. A treadmill with a trampoline-like surface, comprising:

(a) a running surface formed of an endless belt with generally parallel lateral edges;

(b) a support means for supporting the lateral edges of the endless belt for travel between the two points;

(c) suspension means for suspending the endless belt from the support means as the belt travels between the two points, the suspension means including flexible but non-stretchable wire cable positioned between the endless belt and the support means for maintaining a relatively uniform distance between the suspension means and the lateral edges;

(d) means for connecting the flexible wire cable between the support means and the endless belt; and (e) spring means for applying a resiliency to the running surface.

2. The treadmill of claim 1, wherein a series of reinforced openings are spaced apart near the lateral edges of the belt for engagement with the flexible wire cable.

3. The treadmill of claim 1, wherein the support means includes a pair of guide rails spaced apart from the lateral edges of the belt.

4. The treadmill of claim 3, wherein the carrier means include means for engaging with the guide rails.

5. The treadmill of claim 4, wherein the carrier means are formed of two sections, one section having means for engaging with the guide rails and the other section having means for engaging with the wire cables.

6. The treadmill of claim 5, wherein the carrier section means for engaging with the suspension means includes a wire cable thimble.

7. The treadmill of claim 1, wherein the support means further includes roller supports located between the upper and lower surfaces of the belt at each end of the belt.

8. The treadmill of claim 1, wherein the spring means includes at least one resilient section in the endless belt.

9. The treadmill of claim 1, wherein the spring means further includes a pair of resilient sections parallel to and spaced apart from each edge of the belt.

* * * * *